United States Patent [19]

Bishop et al.

[11] Patent Number: 4,923,317

[45] Date of Patent: May 8, 1990

[54] BRUSHLESS WHITE-OUT CORRECTING FLUID APPLICATOR

[75] Inventors: Willis E. Bishop, Diamond Bar; Ghanshyam H. Popat, Alta Loma; Chen Tien-Tsung, Claremont; Manuel W. Ruiz, Carmel Valley, all of Calif.

[73] Assignee: Avery International Corporation, Pasadena, Calif.

[21] Appl. No.: 314,631

[22] Filed: Feb. 23, 1989

Related U.S. Application Data

[63] Continuation-in-part of Ser. No. 21,457, Mar. 4, 1987, abandoned.

[51] Int. Cl.[5] ..... B43K 8/02

[52] U.S. Cl. ..... 401/205; 401/206; 401/260

[58] Field of Search ..... 401/199, 198, 200, 205, 401/207, 206, 196, 260, 25, 27; 106/19, 21

[56] References Cited

U.S. PATENT DOCUMENTS

| | | | |
|---|---|---|---|
| 1,933,893 | 11/1933 | Clark | 401/202 |
| 2,481,803 | 9/1949 | Weaver | 401/25 |
| 2,783,488 | 4/1985 | Jockers | 401/206 |
| 3,108,314 | 10/1963 | House | 401/202 |
| 3,266,079 | 8/1966 | Schwartzman | 401/202 |
| 3,349,966 | 10/1967 | Schwartzman | 222/80 |
| 3,378,330 | 4/1968 | Schwartzman | 401/260 |
| 3,393,963 | 7/1968 | Nadai | 401/207 |
| 3,471,245 | 10/1969 | Schwatzman | 401/207 |
| 3,661,468 | 5/1972 | Schwartzman | 401/206 |
| 3,881,828 | 5/1975 | Jones | 401/199 |
| 3,997,498 | 12/1976 | Reese et al. | 106/19 X |
| 4,050,826 | 9/1977 | Berghahn | 401/196 |
| 4,157,874 | 6/1979 | Durand | 401/206 X |
| 4,342,522 | 8/1982 | Mackles | 401/200 X |
| 4,364,684 | 12/1982 | Kohno et al. | 401/206 X |
| 4,384,589 | 5/1983 | Morris | 132/88 |
| 4,511,273 | 4/1985 | Trotta | 401/260 |
| 4,568,214 | 2/1986 | Abe et al. | 401/196 X |
| 4,569,612 | 2/1986 | Schwartzman | 401/206 |
| 4,588,319 | 5/1986 | Niemeyer | 401/206 X |
| 4,712,571 | 12/1987 | Remz et al. | 401/206 |
| 4,732,614 | 3/1958 | Brooks et al. | 106/21 |

FOREIGN PATENT DOCUMENTS

| | | | |
|---|---|---|---|
| 1250302 | 9/1967 | Fed. Rep. of Germany | 401/199 |
| 2547000 | 4/1976 | Fed. Rep. of Germany | 401/199 |
| 1408098 | 6/1965 | France | 401/199 |
| 1436956 | 3/1966 | France | 401/205 |
| 80467 | 5/1982 | Japan . | |
| 57-198769 | 12/1982 | Japan | 401/206 |
| 581970 | 11/1976 | Switzerland | 401/268 |

*Primary Examiner*—Richard J. Johnson

*Attorney, Agent, or Firm*—Poms, Smith, Lande & Rose

[57] ABSTRACT

A brushless white-out correcting fluid applicator for use in applying white-out fluid to paper without using a brush. The white-out fluid is a suspension including a substantial proportion of white or substantially white particles, such as titanium dioxide, or other color particles. The applicator includes a wear-resistant, porous tip and a regulator between the tip and a reservoir. The regulator may be formed of foam material, and the tip may be of sturdy porous plastic. The size of the pores in the tip and regulator are large enough so that they do not become clogged with particles in the white-out fluid. The regulator prevents the tip from dripping by regulating the rate at which fluid can leave the reservoir. The size of the pores adjacent the reservoir may be different than the size of the pores and passageways adjacent the tip. The applicator may be provided with an air-tight cap to avoid drying out between uses. Alternative embodiments of the applicator include a foam tip with a nylon mesh outer covering for wear resistance; and an internal, pressure actuated valve may be included to regulate the flow of the white-out suspension to the tip.

18 Claims, 3 Drawing Sheets

BRUSHLESS WHITE-OUT CORRECTING FLUID APPLICATOR

Related Patent Applications

This patent application is a continuation-in-part of U.S. patent application Ser. No. 021,457, filed Mar. 4, 1987 now abandoned.

FIELD OF THE INVENTION

This invention relates in general to dispensing applicators and, more particularly, to dispensing applicators which dispense white-out correcting fluid.

BACKGROUND OF THE INVENTION

Users of typewriters often make mistakes in pressing typewriter keys, resulting in incorrect characters being typed onto a typing page. To correct such errors, white-out correcting fluid is available which can be applied directly over the incorrect characters. The white-out fluid produces a smooth, consistent surface which completely covers the incorrect character and is suitable for retyping.

The smooth, consistent characteristics of white-out fluid are largely a result of the particles or flakes of titanium dioxide which is suspended in the fluid. Titanium dioxide helps the material to appear opaque and white.

At present, white-out fluid is commonly sold in small containers which are equipped with brushes attached to the container top. A user unscrews the top and pulls it and the attached brush away from the container. Generally, the brush contains too much white-out fluid which requires the user to carefully brush the brush against the inside of the container to remove excess fluid. The user can then touch the brush to paper and return the brush to the container.

This procedure is time consuming. Accordingly, it would be desirable to provide a brushless applicator of white-out fluid. In fact, there have been many attempts involving a great deal of research extending over several years to provide a brushless applicator for white-out correcting fluid. There has been a long felt need within the industry for such an applicator.

It is noted in passing that certain types of marking pen structures and shoe polish applicators have been proposed heretofore which are suitable for their intended purposes, but which are unsuitable for the brushless application of white-out type suspensions.

SUMMARY OF THE INVENTION

Several competing phenomena have prevented a brushless applicator from being successfully designed until the present invention. First, an applicator tip must have pores which are large enough to allow the particles within the fluid to pass through it or else the tip will become clogged and not allow enough fluid through. Second, if the pores are too large or if the tip contains canals or channels and no flow regulating arrangements are provided, the applicator tip will release too much fluid and have a dripping characteristic. The tip must also be wear-resistant. Foam material has good flow regulating properties but poor wear-resistance. Porous plastic has good wear-resistance but relatively poor flow regulating qualities, because of the canals or channels of relatively large diameter through it. Nylon mesh is similar to porous plastic in having good wear-resistance, but no flow regulation.

Accordingly, it is a principal object of the invention to provide a brushless white-out correcting fluid applicator which will provide a consistent flow of white-out type suspension, without dripping or clogging.

The present invention, in a broad aspect, is a brushless white-out correcting fluid applicator including a reservoir which contains the white-out fluid and a porous applicator which is permanently connected to the reservoir.

In one embodiment, the applicator includes a porous regulator which may be made of foamed or sponge-type material, and a flexible but fairly stiff porous plastic tip with elastomeric properties. The size of the pores in the foam regulator are adapted to be larger than the size of the largest particles commonly found in white-out fluid or suspension. The size of the openings in the porous plastic tip should also be larger than the white-out particles. The regulator prevents fluid from flowing too quickly through the tip, thus preventing dripping.

In accordance with one feature of the invention, the pores, channels, or openings in the tip may be relatively large as compared with the openings in the flow regulating material adjacent the reservoir for the white-out suspension, and the pores or channels in the regulator material face may be slightly larger than the largest particles in the white-out suspension. Further, the progression in pore or channel size may be achieved through layering, or by forming a single body of material with progressively increasing pore or channel size. With this arrangement, if there is an occasional large particle, it will not become clogged in the middle of the foam or porous plastic, but will remain on the surface of the regulator near the reservoir, so that it may be shaken loose by shaking the unit.

Instead of using foam material as the regulator, an additional section of porous plastic may be employed; and this regulator section of porous plastic may be integral with the tip or formed separately, and in either case the tip and the regulator may have different porosity.

In accordance with another aspect of the invention, the length of the flow regulating material from the reservoir to the tip of the applicator may be equal to or greater than the transverse dimension or diameter of the regulating material.

From another broad aspect of the invention, a brushless white-out type correcting fluid applicator includes a porous plastic wear-resistant tip means for engaging the paper and a flow regulator between the wear-resistant tip and the white-out suspension reservoir. The regulator may be in the form of a body of foam material, or in the form of a valve which is actuated when pressure is applied to the tip means.

In accordance with a further feature of the invention, the foam regulator material may be directly exposed to the reservoir containing the white-out fluid, without the interposition of any valving structure or the like, so that a simple and inexpensive assembly is provided.

It is further noted that the foam regulating material is preferably in direct contact with the porous plastic without an interposed volume of white-out type fluid which might otherwise drip through the porous plastic.

It is further noted that there is a high concentration of solid materials in the white-out type fluid, normally in the order of 40% to 70% by weight. This is in contrast to the much lower percentage of solids in inks, normally about 10% to 14%, with a normal maximum of about 20%. The relatively high percentage of solids in white-out type fluid creates a special problem relative to clogging and the like; and it has been found that structures designed for pen use to dispense inks will clog or become inoperative when white-out type fluids are used with them.

Other objects, features and advantages of the invention will become apparent from a consideration of the following detailed description, and from the accompanying drawings.

DETAILED DESCRIPTION OF THE DRAWINGS

Figure 1:
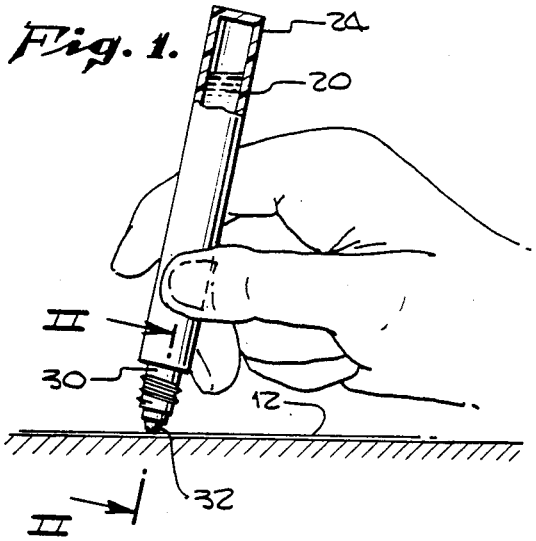
FIG. 1 is a perspective view of a brushless white-out fluid applicator apparatus illustrating the principles of the invention.

Referring more particularly to the drawings, brushless white-out fluid applicator apparatus 10 illustrating the invention is shown in operating position with respect to paper 12 in FIG. 1. The apparatus 10 is comprised of reservoir 20 and transferring section 30. Reservoir 20 is encased by a rigid or semi-rigid container wall 24.

In operation, when a typist makes a typing mistake, the typist unscrews apparatus top 40 (shown in FIG. 5), and touches the stiff, but slightly flexible, porous plastic tip 32 to the area of the paper which contains the typing error. The tip 32 may flex slightly but returns to its original configuration when pressure is removed. Tip 32 readily applies white-out fluid or suspension to paper whether the user touches tip 32 to a single typed character or strokes tip 32 across an entire line. The semi-rigid container wall 24 may be squeezed gently to provide increased fluid flow. When a rigid container wall is used, squeezing is not required. Apparatus 10 produces a smooth, consistent layer of white-out fluid which is substantially identical to layers produced by standard off-the-shelf white-out fluid brushes applying white-out fluid, and can be used to cover substantially any type or color of ink that the standard brushes can cover.

Figure 2:
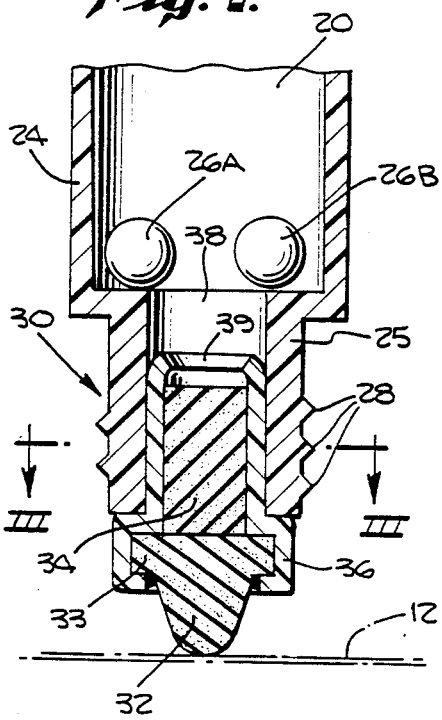
FIG. 2 is a cross-sectional view of one end of the applicator as shown in FIG. 1, taken through the plane II—II of FIG. 1.

FIG. 2 shows a sectional view of the tip of apparatus 10. Reservoir 20 holds the white-out fluid or suspension until it is transferred through transferring section 30. Transferring section 30 is located in cavity 38 and is surrounded by wall 25 which is integral with container wall 24. Transferring section 30 is comprised of porous plastic tip 32, regulator 34, and the retaining sleeve 36. Opening 39 allows white-out fluid to flow into transferring section 30. White-out fluid contains particles of titanium dioxide and/or other materials which have maximum transverse dimensions of about 60 microns. Regulator 34 is made of foam which has pores or channels with diameters slightly greater than 60 microns, such as about 65 microns. Therefore, particles of titanium dioxide will not become lodged in the pores of regulator 34 as white-out fluid passes through it.

Porous tip 32 may contain pores or channels with a diameter of about 100 microns. The diameter of the pores of tip 32 are adaptable to provide optional fluid flow levels. The greater the pore size, the greater the rate of flow of white-out fluid which passes through it subject to the regulating effect of regulator 34. Porous tip 32 is made of a stiff material chosen to have minimal wear resulting from contact with the paper. In practice, porous tip 32 is found to contain canals which, without a compensating or regulating material allows white-out fluid to drip from tip 32. To prevent dripping, regulator 34 is placed above porous tip 32. The combination of regulator 34 made of resilient foam type material and stiff porous tip 32 is found to be very successful in controlling dripping. The small ball bearings 26A and 26B are used to maintain particles in suspension, as is well known to those of ordinary skill in the art.

Figure 3:
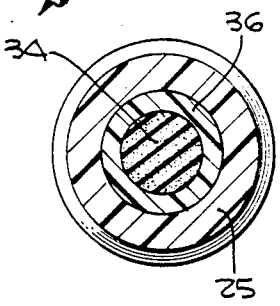
FIG. 3 is a transverse view of the apparatus as shown in FIG. 1, taken through the plane III—III of FIG. 2.

The cross-sectional view of FIG. 3 shows container wall 25, threads 28 (see FIG. 2), retaining sleeve 36, and regulator 34 in a view of the applicator of FIGS. 1 and 2 taken through plane III—III of FIG. 2.

Figure 4:
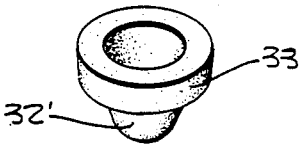
FIG. 4 is a perspective view of one form of applicator tip which may be used with the applicator of FIGS. 1–3.

FIG. 4 shows a perspective view of porous tip 32'. Flange 33 (see FIG. 2) is provided to lock porous tip 32' within the bracket or retaining member 36. Tip 32 can be cup-shaped as shown in FIG. 4 formed from porous sheet material or alternatively it may be a solid member 32 as shown in FIG. 2 without the recess shown the upper surface of FIG. 4.

Figure 5:
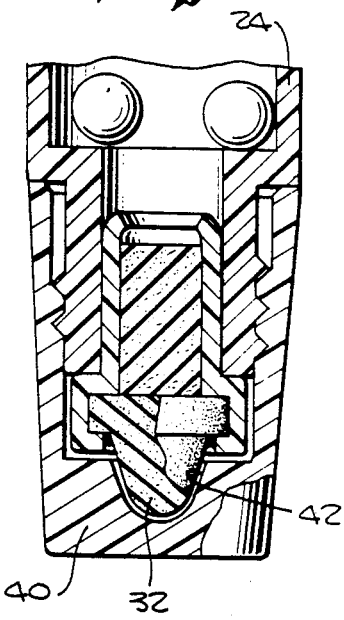
FIG. 5 is a cross-sectional view of the applicator of FIG. 1, taken through the plane II—II, shown with an applicator closure cap mounted over the tip thereof.

FIG. 5 shows container top or cap 40 attached to apparatus 10 by standard threading. Cap 40 is designed to have only a very small air gap 42 to minimize the amount of fluid retained in the cap if the apparatus is dropped on a hard surface, and to prevent white-out fluid from drying on tip 32. Top 40 and wall 24 create an airtight seal. Other than top 40, FIG. 5 is substantially the same as FIG. 2.

Figure 6:
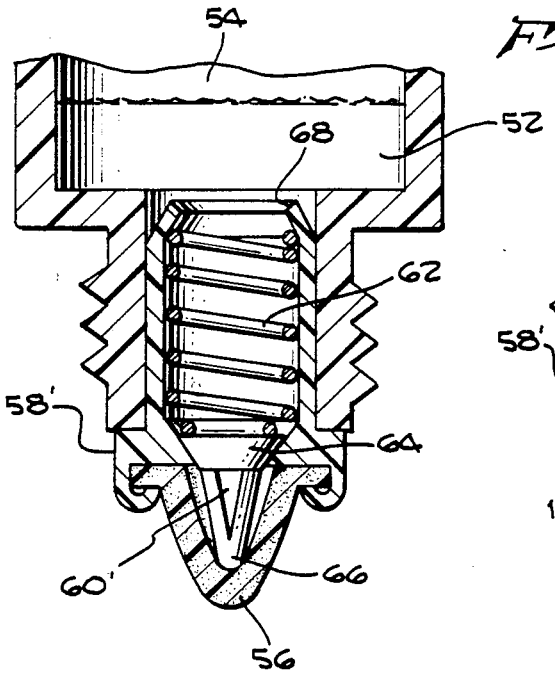
FIG. 6 illustrates an alternative embodiment of the invention using a regulator valve.

FIG. 6 shows an alternative embodiment of the invention, in which the fluid reservoir 52 includes the white-out fluid suspension 54, and a porous plastic tip 56 being held in place by the insert 58. Regulation of the flow of the suspension 54 to the porous plastic tip 56 is accomplished by the valve member 60 which is normally biased downwardly as shown in FIG. 6, by the spring 62 so that it closes the valve seat 64. When the porous plastic tip 56 is pressed upon the paper and deflected to some limited extent, the fluted outer end 66 of the valve member 60 is engaged, so that the valve member 60 is shifted from its closed configuration, to permit the flow of the white-out suspension from the reservoir 52 into the porous plastic tip 56. Incidentally, the uppermost turns of the coil spring 62 are retained in position by the inturned upper end 68 of the insert 58. Thus, in the arrangement of FIG. 6, the regulation of the flow of white-out fluid is accomplished by the use of a valve structure, instead of by the use of porous plastic or foam material.

Figure 7:
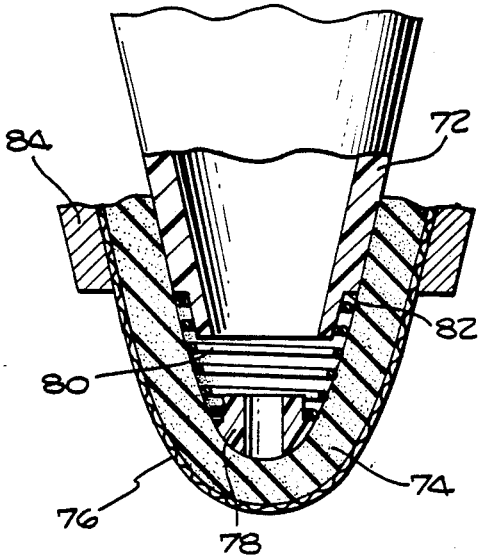
FIG. 7 is a cross-sectional view of another alternative applicator tip.

Turning now to FIG. 7, another alternative embodiment of the invention is shown. The barrel 72 of a container for a white-out type suspension is provided with a tip which includes a fairly thick layer 74 of elastomeric or flexible foam material, and an outer layer 76 of nylon mesh to provide wear resistance for the surface which will actually come into engagement with the paper or other material to which the correction fluid will be applied. Of course, the nylon mesh has apertures which are somewhat greater than the maximum diameter of the particulate material in suspension in the white-out fluid. In order to provide appropriate support for the normally flexible foam layer 74, a rigid plastic member 78 having a central aperture is provided, and it is held in place by the spring 80 which engages a shoulder on the rigid plastic member 78, and a second shoulder 82 at the outer end of the barrel 72 with the possible assistance of suitable adhesives. A plastic retaining band 84 is provided to hold the nylon mesh and the foam tip in place on the end of the barrel 72, with the possible assistance of suitable adhesives between parts 72, 74, 76 and 84. In the arrangement of FIG. 7, the porous nylon mesh 76 provides good wear-resistance properties, and the metering or regulating of the flow of white-out type fluid is accomplished by the fairly thick layer of foam material 74.

Figure 8:
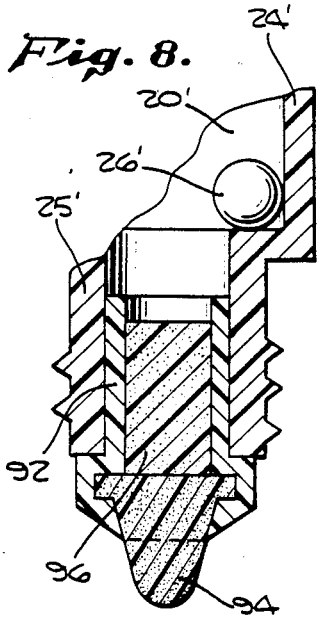
FIG. 8 shows a further alternate tip arrangement in which both the tip and the regulator are formed of porous plastic.

Referring now to FIG. 8, the construction is similar to that of FIG. 1 with the inclusion of a barrel 24′ having a forward portion 25′ in which a retaining sleeve 92 is provided. Secured within the retaining sleeve 92 is a porous plastic tip 94 and a porous plastic flow regulator member 96. The two sections may be molded together at the same time, or molded separately and fused together using a process similar to the molding process. Porous plastic characteristically has channels or canals which are of fairly large diameter as compared with the normal pore spacing throughout the bulk of the material. These channels or canals may permit dripping or splashing of the white-out fluid unless precautions are taken. Accordingly, it is desirable that either section 94 or 96 have relatively small pore size. To prevent dripping or splattering in the embodiment of FIG. 8, it is preferred that the tip portion 94 have relatively small pores, barely larger than the maximum particle size in the suspension, while the regulator section 96 may have somewhat larger pores, with the length of section 96 being substantial, preferably greater than its diameter, to provide the desired smooth and regulated flow of the white-out suspension. If the parts are molded together at the same time, the pore size may vary as a gradient from fine at the tip, gradually increasing in size to coarse at the upper extremity of the regulator section.

Figure 9:
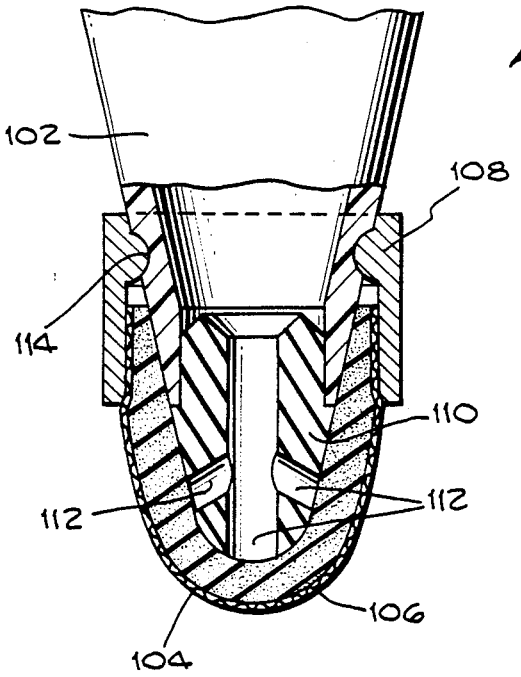
FIG. 9 is a cross-sectional view of another alternative tip construction.

FIG. 9 shows a further alternative embodiment of the invention in which the barrel 102 of the unit has at its outer end a tip including a layer of elastomeric or flexible foam material 104 and an outer layer of nylon mesh 106 similar in position and function to the arrangement of FIG. 7. An outer retaining band 108 holds the foam and the nylon mesh in their proper position, in cooperation with the inner elastomeric flexible tip support 110 which is mounted within, and in engagement with, the foam tip member 104. The inner support member 110 may be of suitable rubbery material such as silicone rubber, and is provided with openings 112 through which the white-out fluid may flow to the foam material 104. The retaining band 108 may be held in a suitable annular recess 114 in the outer surface of the barrel 102 by engagement with an inwardly directed ridge on the retaining band 108. Adhesive material may also be used to hold the various elements of the tip assembly together.

Figure 12:
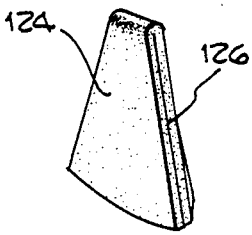
FIGS. 10–12 show an additional tip construction using a specially formed foam flow regulator element.
Figure 10:
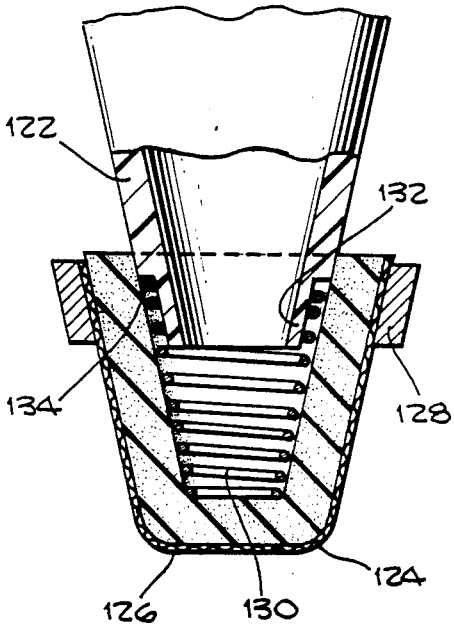
Figure 11:
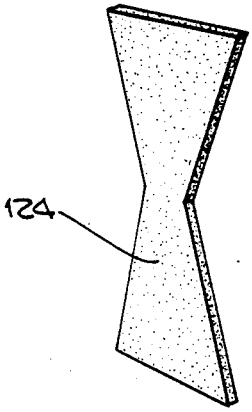

Another embodiment of the invention is shown in FIGS. 10 through 12 of the drawings. In this embodiment, the barrel 122 is again provided with a foam tip 124 and an outer nylon mesh covering 126 for wear-resistance. A retaining band 128 holds the nylon mesh and the foam tip onto the end of the barrel 122, with the possible assistance of appropriate adhesives. Support is provided for the flexible and resilient foam tip member 124 by the spring 130 which is mounted on the protruding portion 132 of the barrel 122, with the broader end of the tapered spring 130 engaging the shoulder 134 which extends around the outer end of the barrel 122.

The foam tip 124 as shown in FIG. 10 may be cut from a flat piece of foam sheet material, as indicated in FIG. 11. Following cut-out of the foam tip from a sheet of foam material, as indicated in FIG. 11, it is folded as indicated in FIG. 12, and heat-sealed along the mating edges as indicated at reference numeral 126 in FIG. 12.

Figure 13:
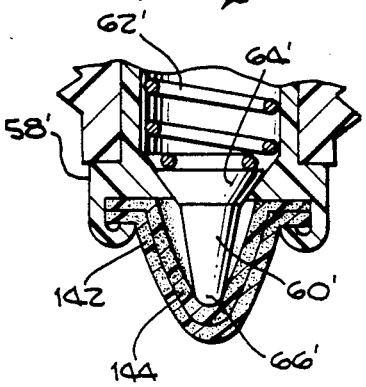
FIG. 13 is a fragmentary view showing a further alternative embodiment of the invention.

The embodiment of FIG. 13 is similar to that of FIG. 6, except for the tip, and corresponding parts of FIG. 13 will carry primed reference numerals otherwise corresponding to FIG. 6. In FIG. 13, the tip is formed of two fairly thick nested cones 142 and 144, with the outer portion 142 of the tip being formed of porous plastic, and the inner portion 144 being formed of elastomeric or flexible foam material. As in the case of other embodiments of the invention, the foam has better regulating action, and the porous plastic has better wear resistance, so the applicator of FIG. 13 has good regulated flow without dripping or splattering of the white-out suspension.

Incidentally, although not shown in FIGS. 6 through 13, it is to be understood that these embodiments of the invention may be provided with air-tight caps, which are secured to the barrel of each of the units in any conventional manner, by mating recesses, or by screw threads, by way of specific examples.

The composition of the white-out fluid used with the present invention is substantially similar to standard off-the-shelf white-out fluid. It may have a water and alcohol base or it may contain a solvent such as 111 Tri-chloroethane in which case no alcohol is used.

The composition of the materials employed in the implementation of the invention discussed above depend on whether the white-out fluid they are to be used with has a water and alcohol base or contains solvent. If the fluid has a water and alcohol base, then tip 32 may be made of porous plastic, such as ethylene vinyl acetate (EVA). Regulator 34 may be made of foam polyurethane, retaining sleeve 36 of polystyrene, and container wall 24 of polypropylene or polyethelyne, each of which is not solvent resistant.

If the solvent 111 tri-chloroethane is used, then regulator 34 may be made of polyester foam, and container wall 24 and bracket 36 of Berex.

The white-out fluid may contain 30–70% by weight titanium dioxide, and 2–20% by weight clay, with the purpose of the clay being to cut back the brightness of the titanium oxide. More specifically, the total amount of solids in the white-out type fluid is preferably about 40% to 70%. This is in contrast to the percentage of solids in inks, such as white ink, for specific example, which is normally about 10% to 14% with a normal maximum of about 20%. Water and alcohol based white-out fluid including 18–25 oz. fluid may contain 20–70% water, 2–15% alcohol, 0.1–10% surfactant (which disperses the pigment) and 0.1–3% defoamer.

Polyester foam for regulator 34 may be obtained from American Filtrona Co. 8401 Jefferson Davis Highway, Richmond, Virginia 23234. Porous plastic for tip 32 may be obtained from Porex Technologies Corporation, 500 Bohannon Road, Fairburn, Georgia 30213. In ordering the materials, it is necessary to specify the size of the pores required.

For completeness, it may be noted that the porous plastic is normally formed from small particles of plastic which are fused together, by any of a number of known different processes. Various plastics may be used, including ethylene vinyl acetate. The porous plastic is fairly stiff, but flexes to a limited extent, and has good wear-resistance properties. The foam is flexible or elastomeric open cell foam material which is normally formed in the course of a chemical reaction in which gas bubbles are formed, initially forming closed cells. By a subsequent process the closed cells are formed into an interconnected open cell configuration. The foam is very flexible and compressible, but has relatively poor wear-resistance qualities, so that it is not appropriate for the surface of the tip which is intended to contact the paper. Incidentally, the porous plastic has a hardness in the range of approximately 15–60 on the Type A Durometer scale, conforming to ASTM 2240–75. The foam material is quite flexible, as mentioned above, and would have a significantly lower hardness than the range indicated above for the porous plastic. It is noted in passing that foam plastic material normally has a somewhat more uniform physical configuration composition and pore distribution than the porous plastic, with the variation being in the order of plus or minus 10%. The pore distribution in foam material is normally given in terms of pores per inch (PPI), and we have determined that good results may be achieved with foam having in the order of 90 PPI, with satisfactory results being obtained with foam having pore distribution from 30 PPI to 100 PPI. With porous plastic, there is a greater variation in pore size, as much as plus or minus 40% from nominal, and with occasional canals or channels through the material of substantial greater size. These channels are thought to permit dripping and splattering when additional regulation is not provided. In general, a nominal pore size of between 50 and 100 microns is preferred for the porous plastic. When reference is made herein to foam material or to porous plastic material in this specification and claims, reference is made to the types of materials (but not the specific chemical compositions) as discussed in this paragraph.

In one working embodiment, the applicator unit with the cap on was about 5 inches in length, and $\frac{5}{8}$ inch in diameter. The preferred diameter is between $\frac{3}{8}$ and $\frac{3}{4}$ inch, and the preferred length is from about 3 to 6 inches. The regulator member 30 is approximately 5/16 inch in diameter and about one-half inch long, and more generally, preferably has a length from the reservoir to the tip which is equal to or greater than its transverse dimension. The thickness of the tip 32 from inside to outside is greater than 1/64 of an inch, and preferably greater than 1/32 of an inch.

As mentioned above, certain prior arrangements have been proposed for dispensing fluids, shoe polish or medication, and three patents disclosing such arrangements are G. Schwartzman U.S. Pat. No. 3,349,966, issued Oct. 31, 1967; U.S. Pat. No. 3,661,468, issued May 9, 1972; and U.S. Pat. No. 4,569,612, issued Feb. 11, 1986. However, these patents are relatively complex as compared with several of applicant,s basic arrangements in which the porous material is directly and permanently coupled to the chamber containing the white-out suspension, and include no valve. It is further noted that many of applicants, arrangements feature the use of relatively stiff porous plastic having a hardness rating in the order of 15–60 on the durometer A-scale, for the tip portion which engages the paper, to accurately engage single letters or typed lines, and to provide a wear-resistant applicator. This is in contrast to the broad area, soft applicators disclosed in the Schwartzman patents.

In the foregoing description of the present invention, a preferred embodiment has been disclosed including two sets of materials and chemical compositions depending on whether the white-out fluid has a water and alcohol base or contains a solvent. It is to be understood that various design variations are within the scope of the present invention and that the present invention is not limited to the particular arrangements and materials which have been illustrated and described herein. For example, the flexibility and porosity of tip 32 may be varied. Tip 32 may be created from molds. The regulator and tip may be formed as a single member. The dimensions of the pores and channels in regulator 34 and tip 32 may be consistent throughout the material or vary in a predetermined manner. The size of the pores depends on the dimensions of the particles in the white-out fluid, and are chosen to be somewhat larger for both the foam and the porous plastic so that clogging will not occur. Accordingly, it is to be understood that the present invention is not limited precisely to the showings in the drawings or to the detailed description set forth herein above.

What is claimed is:

1. A brushless white-out type fluid applicator comprising:

an elongated applicator housing;

correction fluid or suspension within said applicator housing, said correction fluid including a substantial proportion at least 40 percent by weight, of particulate material of a predetermined range of sizes, with the upper end of said range comprising particles of a predetermined maximum diameter;

porous plastic tip means having a flexible wear-resistant surface and sized generally for applying said correction fluid to a single letter or line of print on paper, said porous plastic tip means having pores and channels therein;

regulator means between said tip and said reservoir for controlling the flow of fluid and for preventing dripping;

the pores or channels in said tip means and maximum flow control opening of said flow regulator means having a cross-section at least slightly greater than said maximum diameter of said particles, whereby clogging of said regulator means or said tip means is prevented; and said tip means being formed of stiff porous plastic material, and said regulator means including flexible, spongy, porous foam material extending across and in substantial engagement with a surface of said porous plastic material facing toward said reservoir.

2. An applicator as defined in claim 1 wherein said maximum diameter is approximately 60 microns.

3. An applicator as defined in claim 1 wherein the fluid path through said regulator extends for a distance at least equal to or greater than the transverse dimension of said regulator.

4. An applicator as defined in claim 1 wherein the diameter of the pores or channels through said regulator are less than the corresponding diameter of the pores or channels through the tip.

5. An applicator as defined in claim 1 wherein said tip means is formed of stiff porous plastic material, and wherein said regulator means is formed of flexible, spongy, porous foam material.

6. An applicator as defined in claim 1 wherein the maximum diameter of the particles in the correction fluid suspension is about 80 microns, and this is the minimum diameter of the pores or channels in the regulating means and the tip means.

7. An applicator as defined in claim 1 wherein close fitting cap means are provided for securing said tip to prevent drying out of said tip when the applicator is not in use.

8. An applicator as defined in claim 1 wherein said housing is in the order of $\frac{1}{2}$ to $\frac{5}{8}$ inch in diameter and is at least $3\frac{1}{2}$ inches in length.

9. An applicator as defined in claim 1 further comprising retaining means for mounting the regulator means and the tip means on one end of said applicator housing.

10. An applicator as defined in claim 1 wherein said tip means is formed of relatively stiff porous plastic, having a hardness in the range of 15–60 on the Type A Durometer scale.

11. An applicator as defined in claim 1 wherein said regulator means includes valve means responsive to pressure on said tip means for permitting increased flow of fluid from said reservoir to said tip means.

12. An applicator as defined in claim 1 wherein said tip means is formed of relatively stiff porous plastic.

13. A brushless white-out correcting fluid applicator for completely covering typed words on paper or the like with white-out correcting fluid which when dry can be typed over, said applicator comprising:

reservoir means for containing said white-out fluid before it is applied to said paper;

white-out fluid containing at least 40 percent by weight of titanium dioxide in said reservoir means;

applicator means including porous material for applying said white-out fluid from said reservoir means to said paper, said applicator means being connected to said reservoir means throughout an entire process of applying said white-out fluid to said paper, said applicator means being in direct contact with said paper during said process of applying said white-out fluid to said paper, said applicator means including pores or channels the diameter of which are at least slightly larger than the size of the largest particles commonly present in said white-out fluid, such that said applicator does not become clogged with said white-out fluid;

said porous material being permanently and directly coupled to said reservoir means;

said applicator means including highly wear-resistant means formed of stiff porous plastic material having pores and channels, at the outer surface of said tip for engaging the paper;

said applicator means further including regulating means formed of spongy foam material for regulating the rate at which said white-out fluid flows from said reservoir means, said foam material having interconnected open cells forming passageways through the regulating means, said spongy foam material being in substantial engagement with said porous plastic material;

the diameter of the passageways through said regulating means being in the order of about 60–80 microns, and the diameter of the pores or channels in said porous plastic being greater than the largest size particles in said white-out fluid.

14. An applicator as defined in claim 13 wherein said foam material is generally cup-shaped, and further comprising means for providing supplemental support to said foam material.

15. An applicator according to claim 13, said applicator means comprising:

regulating means for regulating the rate at which said white-out fluid flows from said reservoir means, said regulating means being porous; and tip means for transferring said white-out fluid from said regulator means to said paper, said tip means also being porous.

16. An applicator according to claim 15, wherein the diameter of the pores in said regulating means are only slightly larger than the largest particle in said white-out fluid, and the diameter of the pores in said tip means are different than the pores in said regulating means.

17. An applicator according to claim 15 wherein the diameter of the pores or channels in said regulating means is in the order of about 60–80 microns, and the diameter of the pores or channels in said tips means is slightly greater than the diameter of the pores or channels in said regulating means.

18. A brushless white-out type fluid applicator comprising:

an elongated applicator housing;

correction fluid or suspension within said applicator housing, said correction fluid including a substantial proportion at least 30 percent by weight of particulate material of a predetermined range of sizes, with the upper end of said range comprising particles of a predetermined maximum diameter;

a porous plastic tip means having a wear-resistant surface and sized generally for applying said correction fluid to a single letter or line of print on paper, said porous plastic tip having a thickness greater than one-thirty-second of an inch; said porous plastic tip means having pores and channels therein;

regulator means between said tip means and said reservoir for controlling the flow of fluid and for preventing dripping;

the pores or channels in said tip means and the maximum flow control opening or openings of said flow regulator means having a cross-section at least slightly greater than said maximum diameter of said particles, whereby clogging of said regulator means and said tip means is prevented; and said regulator means being formed of foam material in substantial engagement with said porous plastic.

* * * * *

UNITED STATES PATENT AND TRADEMARK OFFICE

CERTIFICATE OF CORRECTION

PATENT NO. : 4,923,317

DATED : May 8, 1990

INVENTOR(S) : Bishop et al.

It is certified that error appears in the above-identified patent and that said Letters Patent is hereby corrected as shown below:

On title page, item 54 Title
delete "white-out"

On title page, item 57 Abstract, line (1)
delete "white-out"

On title page, item 57 Abstract, line (2)
replace "white-out"
with correction On title page, item 57 Abstract, line (3)
replace "white-out"
with correction On title page, item 57 Abstract, line (11)
replace "white-out"
with correction On title page, item 57 Abstract, line (21)
replace "white-out"
with correction fluid Col. 1, Title Line
delete "white-out"

Col. 1, line 14
delete "white-out"

Col. 1, line 20
delete "white-out"

Col. 1, line 22
replace "white-out"
with correction

Col. 1, line 25
replace "white-out"
with correction

UNITED STATES PATENT AND TRADEMARK OFFICE

CERTIFICATE OF CORRECTION

PATENT NO. : 4,923,317

DATED : May 8, 1990

INVENTOR(S) : Bishop et al.

It is certified that error appears in the above-identified patent and that said Letters Patent is hereby corrected as shown below:

Col. 1, line 30
replace "white-out"
with correction

Col. 1, line 34
replace "white-out"
with correction

Col. 1, line 41
replace "white-out"
with correction

Col. 1, line 43 & 44
delete "white-out"

Col. 1, line 50
replace "white-out"
with correction fluid

Col. 2, line 4
delete "white-out"

Col. 2, line 5
replace "white-out"
with correction fluid

Col. 2, line 8
delete "white-out"

Col. 2, line 9
replace "white-out"
with correction

Col. 2, line 17
replace "white-out"
with correction

Col. 2, line 19
replace "white-out"
with correction fluid

UNITED STATES PATENT AND TRADEMARK OFFICE

CERTIFICATE OF CORRECTION

PATENT NO. : 4,923,317

DATED : May 8, 1990

INVENTOR(S) : Bishop et al.

It is certified that error appears in the above-identified patent and that said Letters Patent is hereby corrected as shown below:

Col. 2, line 25
replace "white-out"
with correction fluid

Col. 2, line 28
replace "white-out"
with correction fluid

Col. 2, line 48
delete "white-out type"

Col. 2, line 51
replace "white-out"
with correction fluid

Col. 2, line 57
replace "white-out"
with correction

Col. 2, line 62
replace "white-out type"
with correction

Col. 2, line 65
replace "white-out type"
with correction

Col. 3, line 1&2
replace "white-out type"
with correction

Col. 3, line 5
replace "white-out type"
with correction

Col. 3, line 13
replace "white-out"
with correction

UNITED STATES PATENT AND TRADEMARK OFFICE

CERTIFICATE OF CORRECTION

PATENT NO. : 4,923,317

DATED : May 8, 1990

INVENTOR(S) : Bishop et al.

It is certified that error appears in the above-identified patent and that said Letters Patent is hereby corrected as shown below:

Col. 3, line 44
replace "white-out"
with correction

Col. 3, line 56
replace "white-out"
with correction

Col. 3, line 62
replace "white-out"
with correction

Col. 3, line 64
in two (2) places replace "white-out"
with correction

Col. 3, line 68
replace "white-out"
with correction

Col. 4, line 6
replace "white-out"
with correction

Col. 4, line 7
replace "white-out"
with correction

Col. 4, line 14
replace "white-out"
with correction

Col. 4, line 19 replace "white-out"
with correction

UNITED STATES PATENT AND TRADEMARK OFFICE

CERTIFICATE OF CORRECTION

PATENT NO. : 4,923,317

DATED : May 8, 1990

INVENTOR(S) : Bishop et al.

It is certified that error appears in the above-identified patent and that said Letters Patent is hereby corrected as shown below:

Col. 4, line 24
replace "white-out"
with correction

Col. 4, line 47
replace "white-out"
with correction

Col. 4, line 53
replace "white-out"
with correction

Col. 4, line 63
replace "white-out"
with correction fluid

Col. 4, line 68
replace "white-out"
with correction

Col. 5, line 5
replace "white-out "
with correction fluid

Col. 5, line 13 & 14
replace "white-out"
with correction

Col. 5, line 26
replace "white-out type"
with correction

Col. 5, line 41
replace "white-out"
with correction

Col. 5, line 51
replace "white-out"
with correction fluid

UNITED STATES PATENT AND TRADEMARK OFFICE

CERTIFICATE OF CORRECTION

PATENT NO. : 4,923,317

DATED : May 8, 1990

INVENTOR(S) : Bishop et al.

It is certified that error appears in the above-identified patent and that said Letters Patent is hereby corrected as shown below:

Col. 5, line 67
replace "white-out"
with correction

Col. 6, line 35
replace "white-out"
with correction fluid

Col. 6, line 43
replace "white-out"
with correction

Col. 6, line 45
replace "white-out"
with correction

Col. 6, line 50
replace "white-out"
with correction

Col. 6, line 61
replace "white-out"
with correction

Col. 6, line 65
replace "white-out type"
with correction

Col. 7, line 2
replace "white-out"
with correction

Col. 8, line 6
replace "white-out"
with correction fluid

Col. 8, line 18
replace "white-out"
with correction

UNITED STATES PATENT AND TRADEMARK OFFICE

CERTIFICATE OF CORRECTION

PATENT NO. : 4,923,317

DATED : May 8, 1990

INVENTOR(S) : Bishop et al.

It is certified that error appears in the above-identified patent and that said Letters Patent is hereby corrected as shown below:

Col. 8, line 30 & 31
replace "white-out"
with correction

Col. 8, line 38
replace "white-out type"
with correction

Col. 9, line 41
delete "white-out"

Col. 9, line 43
delete "white-out"

Col. 9, line 45
replace "white-out"
with correction

Col. 9, line 47
replace "white-out"
with correction

Col. 9, line 50
replace "white-out"
with correction

Col. 9, line 53
replace "white-out"
with correction

Col. 9, line 56
replace "white-out"
with correction

Col. 9, line 59
replace "white-out"
with correction

UNITED STATES PATENT AND TRADEMARK OFFICE

CERTIFICATE OF CORRECTION

PATENT NO. : 4,923,317

DATED : May 8, 1990

INVENTOR(S) : Bishop et al.

It is certified that error appears in the above-identified patent and that said Letters Patent is hereby corrected as shown below:

Col. 9, line 61
replace "white-out"
with correction

Col. 10, line 5
replace "white-out"
with correction

Col. 10, line 15
replace "white-out"
with correction

Col. 10, line 23
replace "white-out"
with correction

Col. 10, line 25
replace "white-out"
with correction

Col. 10, line 30
replace "white-out"
with correction

Col. 10, line 39
replace "white-out"
with correction

Signed and Sealed this

Sixth Day of April, 1999

*Attest:*

*Attesting Officer*

Q. TODD DICKINSON

*Acting Commissioner of Patents and Trademarks*